United States Patent [19]

Torii

[11] 4,424,836

[45] Jan. 10, 1984

[54] WARP TENSION REGULATING AND WARP FEED APPARATUS IN CIRCULAR LOOM

[75] Inventor: Soichi Torii, Kyoto, Japan

[73] Assignee: Torii Winding Machine Co., Ltd., Kyoto, Japan

[21] Appl. No.: 469,575

[22] Filed: Feb. 24, 1983

Related U.S. Application Data

[63] Continuation of Ser. No. 202,447, Jul. 2, 1980.

[30] Foreign Application Priority Data

Nov. 29, 1978 [JP] Japan ..... 53-148530

[51] Int. Cl.[3] ..... D03D 37/00

[52] U.S. Cl. ..... 139/13 R; 66/132 R; 139/110

[58] Field of Search ..... 139/13 R, 15, 16, 100, 139/109, 110; 66/132 R

[56] References Cited

U.S. PATENT DOCUMENTS

| | | | |
|---|---|---|---|
| 2,475,059 | 7/1949 | Skeer et al. | 139/110 |
| 3,961,648 | 6/1976 | Torii | 139/13 R |
| 4,129,154 | 12/1978 | Bennelli | 139/110 |
| 4,220,274 | 9/1980 | Schubert et al. | 66/132 R |

FOREIGN PATENT DOCUMENTS

| | | |
|---|---|---|
| 2254663 | 7/1975 | France . |
| 44-26418 | 11/1969 | Japan . |
| 49-144956 | 12/1974 | Japan . |
| 52-33225 | 8/1977 | Japan . |
| 53-35229 | 3/1978 | Japan . |

*Primary Examiner*—Henry Jaudon

*Attorney, Agent, or Firm*—Burgess, Ryan & Wayne

[57] ABSTRACT

In a circular loom in which at least one shuttle is continuously travelled in one direction along an annular guide member and a plurality of shed forming mechanisms arranged annularly and coaxially with the guide member are sequentially opened prior to arrival of the shuttle to form a successive sheds through which the shuttle is to be inserted and passed, a warp tension regulating and warp feed apparatus is mounted. In this apparatus, an annular supporting member fixed to a frame of the circular loom is disposed outside the shed forming mechanisms adjacently thereto, a plurality of dancing levers guiding corresponding warps through yarn guides mounted on the top ends thereof are pivoted on the supporting member for respective warps and resilient means for absorbing variations of tensions on the respective warps is connected to the corresponding dancing levers. A warp feed roller having a peripheral speed higher than the warp consuming speed of the circular loom and having a frictional surface is disposed between a warp supply source and the dancing levers so that the frictional contact force between the warp feed roller and the warps is utilized to control the feed amounts of the respective warps separately, and maintain the tensions on the respective warps within an allowable range.

5 Claims, 7 Drawing Figures

WARP TENSION REGULATING AND WARP FEED APPARATUS IN CIRCULAR LOOM

This is a continuation of application Ser. No. 202,447, filed July 2, 1980.

DESCRIPTION

BACKGROUND OF THE INVENTION (1) Field of the Invention

This invention relates to a warp tension regulating and warp feed apparatus in a circular loom.

(2) Description of the Prior Art

As the loom for weaving a tubular fabric, a circular loom has been known for many years. This circular loom however, involves various problems. For example, the structures of the shed forming mechanism and filling mechanism are more complicated than in the conventional power loom, and the actually aplicable fabric structure is limited to a plain weave structure. Furthermore, the densitites of the warps and wefts constituting a woven fabric are coarser than in a woven fabric made by the conventional power loom. Because of these problems, the known circular looms have hardly been put into practical use.

Bags made from woven fabric of a plain weave structure utilizing tapes of synthetic resins, such as polypropylene, polyethylene resins or synthetic resin strands, such as multifilament yarns or cords of synthetic resins, as warps and wefts have been broadly used for transportation and storage of granules, such as grains, sugar fertilizers and synthetic resin pellets. This is because these bags are strong and light in weight. For manufacturing these bags, a single fabric of a plain weave structure or a tubular fabric of a plain weave structure is produced by known power looms, and then, this fabric is cut into pieces of fabric and the pieces of fabric are sewed to form the bags. Warps and wefts used for formation of these bags are much thicker than yarns used for formation of ordinary clothing fabrics, and therefore, the weave densities of these warps and wefts are very coarse. Accordingly utilization of a circular loom for producing these bags has been taken into consideration. Furthermore, a tubular fabric of a more uniform texture can be made by a circular loom than by the conventional power loom, and in case of a circular loom, since shuttles are moved in one direction, the weaving speed can be increased. Therefore, various attempts have been made to utilize circular looms in not only Japan, but, also, other industrially advanced countries. As a typical instance, there can be mentioned a circular loom previously proposed by us, for example, the circular loom disclosed by U.S. Pat. No. 3,871,413, or a circular loom which has been manufactured and sold by the British Company, Fairbairn Lawson Machinery Ltd. In these circular looms, many warps are guided to a plurality of shed forming mechanisms arranged along an annular shuttle guide member and shuttles travel in one direction along this annular shuttle guide member, prior to arrival of the shuttles, sheds are sequentially formed by the shed forming mechanisms and the shuttles travel and pass through these sheds. Then, the sheds are closed, and prior to arrival of subsequent shuttles, the positions of the shed-forming warps are reversed and sheds are sequentially formed. The shuttles are then inserted and passed through these sheds to form a plain weave structure. A so-formed tubular fabric of a plain weave structure is then taken out from the circular loom. As can be understood from these weaving procedures, in these conventional circular looms, due to the shed forming operation during the weaving process, it is almost impossible to avoid the occurence of tension variation on the respective warps. In these variations if warp tensions are not controlled or compensated for an unbalance is created among tensions on the respective warps. If this unbalance is increased, formation of sheds becomes difficult, resulting in occurence of mispicks. As means for preventing occurrence of such defects, there has been adopted a method in which variations of warp tensions are moderated by using dancing levers. For example, one end of each dancing lever is pivoted on a machine frame and a yarn guide for passing a warp therethrough is formed on the other end of each dancing lever, and a resilient pulling member, such as a spring, is connected to each dancing lever to impart a turning moment coping with the tension of the warp passing through the yarn guide. Accordingly, each dancing lever is allowed to swing under the action of the resilient pulling member according to a variation of the tension on the corresponding warp, and the variation of the warp tension is absorbed and compensated for by this swinging movement of the dancing lever. However, since a dancing lever of this type is allowed to swing only within a certain limited range for absorption of variations of the warp tension, a tension variation of a small amplitude can be effectively absorbed, but a tension variation of a large amplitude cannot completely be absorbed. Generally, in a circular loom, variations of tensions on warps have a large amplitude, and therefore, conventional dancing levers of the above-mentioned type can not be satisfactorily used in the circular loom.

SUMMARY OF THE INVENTION

It is a primary object of the present invention to solve the above-mentioned problems involved in the circular loom by providing a warp tension regulating and warp feed apparatus in which, tension variations of a large amplitude in warps can be sufficiently absorbed and uniform sheds can always be formed, and the difference of the tension among warps in sheds can be minimized.

In accordance with this invention, the above-mentioned object is attained by a warp tension regulating and warp feed apparatus for the circular loom comprising a plurality of shed forming mechanisms arranged along an annular shuttle guide member and dancing levers pivoted on a bracket located outside the shed forming mechanisms adjacently thereto, each of the dancing levers having a yarn guide for guiding a warp to a corresponding heald of the shed forming mechanism wherein means for absorbing variations of tensions on warp is disposed to maintain the angular positions of the dancing levers around the pivoting axes thereof within a certain allowable range, and a feed roller rotating in the yarn feed direction and a guide roller for guiding yarns while keeping them in engagement with the peripheral surface of the feed roller are disposed upstream of the warp tension variation absorbing means with respect to the feeding of warps, whereby the respective warps are positively fed to the respective shed forming mechanisms in amounts corresponding to the tensions on the warps by the frictional contact force of the warps with the peripheral surface of the feed roller.

Accordingly, if the warp tension regulating and warp feed apparatus of the present invention is applied to the conventional circular loom, a desired balance is maintained among tensions of respective warps and variations of tensions on the warps with the lapse of time can be controlled within a practically allowable range, that is, within such a range that a uniform weave structure can be formed while preventing incorrect filling.

DETAILED DESCRIPTION OF THE PREFERRED EMBODIMENTS

For better illustration of the warp tension regulating and warp feed apparatus of the present invention, an embodiment of a circular loom to which the apparatus of the present invention is attached will first be described by reference to FIGS. 1 through 4, prior to entering into the description of the structure and effect of the apparatus of the present invention.

Figure 1:
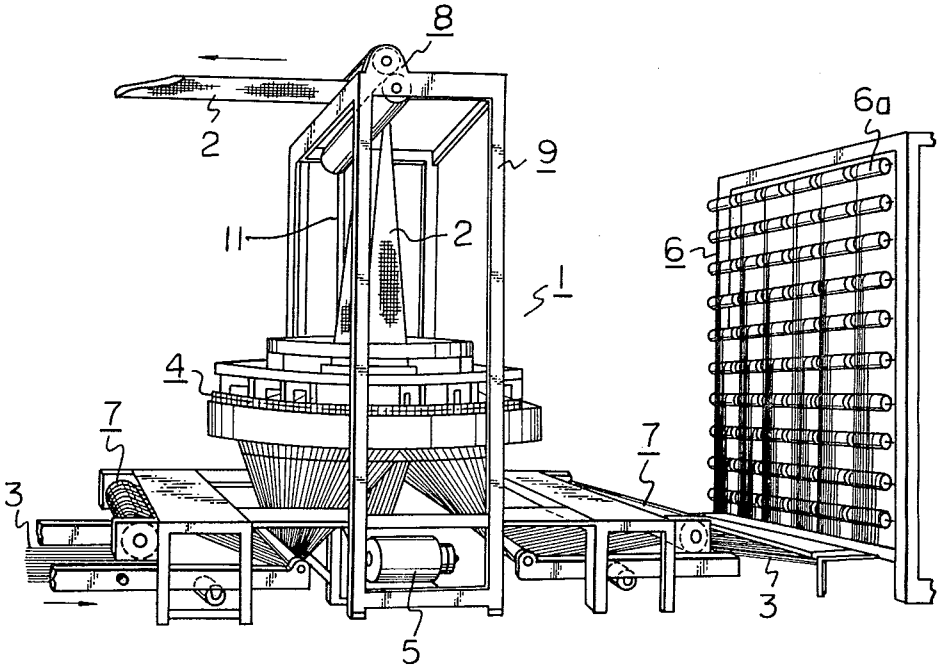
FIG. 1 is a partially omitted perspective view of a circular loom in which the warp tension regulating and warp feed apparatus of the present invention is utilized.

In the circular loom 1 shown in FIG. 1, a main part 4 including shed forming means and filling means is mounted within a frame 9, and the shed forming means and filling means are driven by an electric motor 5 disposed below the main part 4 through a first power transmission mechanism (not shown). Tubular fabric take out means 8 mounted on the frame 9 above the main part 4 is driven by a second power transmission mechanism (not shown) connected to the take-out means 8. Since this second power transmission mechanism is driven by the first transmission mechanism through a driving transmission lever 11, the take-out means 8 is driven while being kept synchronous with the main part 4. Warps 3 of a number necessary for weaving a desirable tubular fabric are held on a pair of creels 6 disposed on both sides of the main part 4 symmetrically with each other with respect to the main part 4 (only one creel disposed on the right side is shown in FIG. 1), from a plurality of yarn packages 6*a* mounted rotatably for feeding warps, and the warps 3 are fed to the main part 4 through warp let-off means 7. The tubular fabric 2 formed by the weaving operation in the main part 4 of the circular loom 1 is upwardly taken out by the take-out means 8 and guided to winding means (not shown) in a direction indicated by an arrow.

Figure 2:
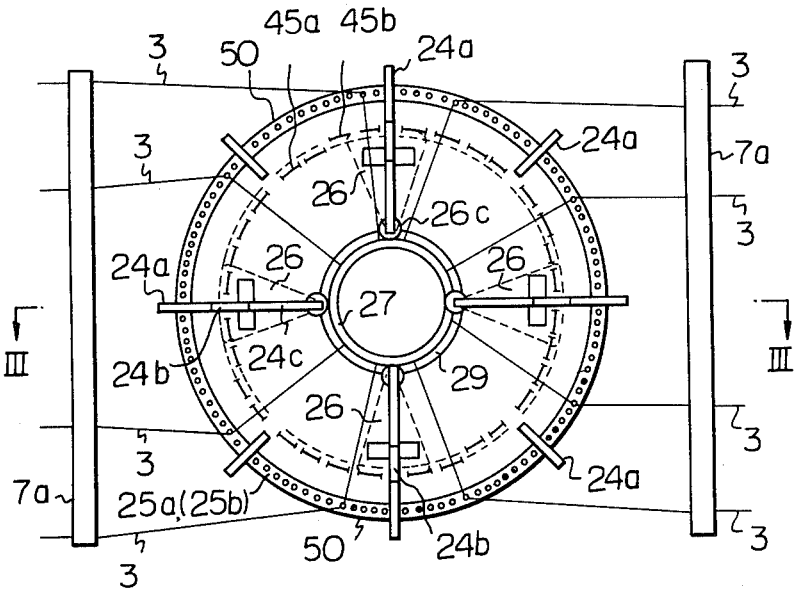
FIG. 2 is a plan view showing diagrammatically the main part of the circular loom illustrated in FIG. 1.
Figure 3:
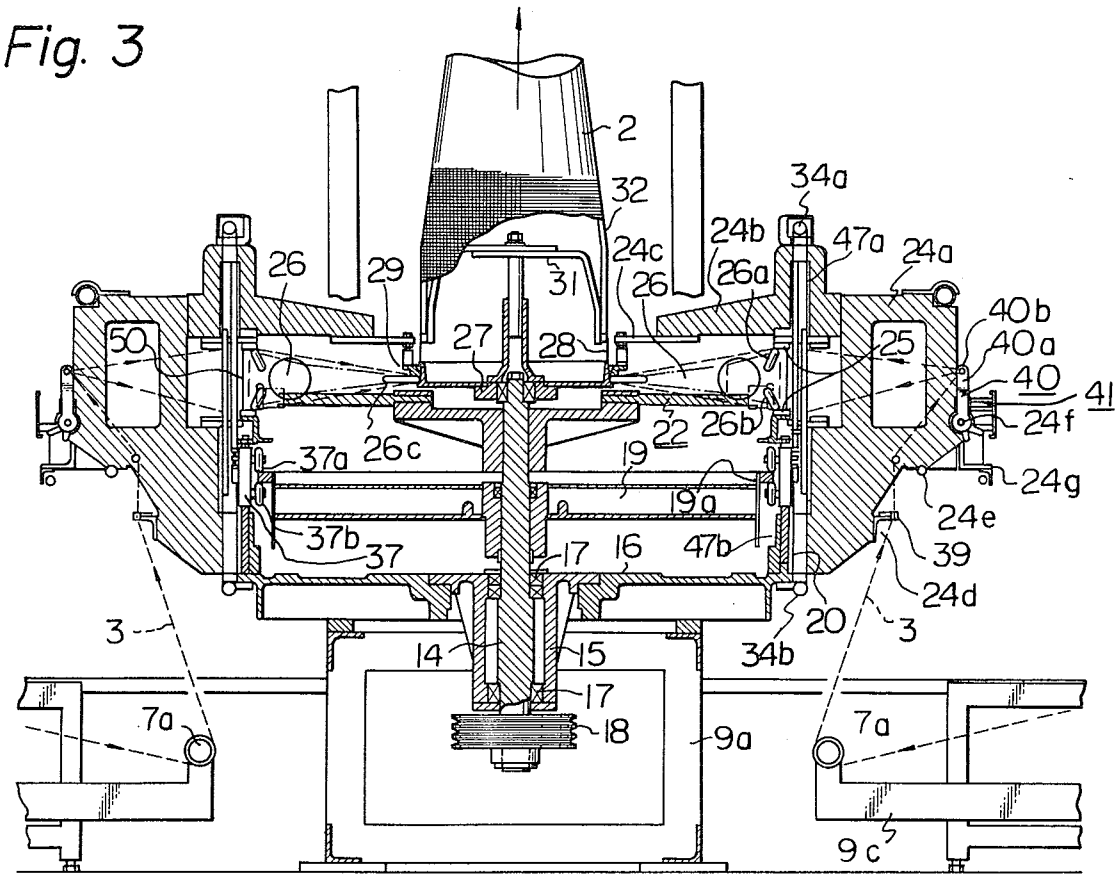
FIG. 3 is a view of the section taken along the line III—III in FIG. 2, which illustrates diagrammatically the main part of the circular loom illustrated in FIG. 1.

As shown in FIGS. 2 and 3, the main part 4 of the circular loom 1 comprises a vertical shaft 14 rotatably supported through a pair of roll bearings mount 17 on bearings 15 fixed to a central opening of a disc-like frame 16 fixed to a base 9*a* of the frame 9, a grooved pulley 18 fixed to the lower end of the vertical shaft 14, a horizontal disc cam mechanism 19 fixed to the shaft 14 at a position above the disc-like frame 16, a shed forming mechanism, discribed hereinafter, which is operated by an annular cam 19*a* of the horizontal disc cam mechanism 19, a shuttle propelling mechanism 22 fixed to the shaft 14 at a position above the horizontal disc cam mechanism 19, a ring shaped guide 25 for guiding a pair of front wheels 26*a* and a pair of rear wheels 26*b* mounted on both the sides of a shuttle 26, a horizontal disc guide member 27 supported rotatably on the top of the shaft 14 to guide another wheel 26*c* of the shuttle 26, an annular guide 29 which is stationarily held through an intermediate member 28 by supporting arms 24*c*, with a slight clearance from the top end of the annular edge of the horizontal disc guide member 27, so as to guide the tubular fabric 2, eight frame members 24*a* fixed to the disc-like frame 16, arms 24*b* fixed to every other one of these frame members 24*a*, a plurality of yarn guides 39 mounted on annular members 24*d* fixed to the frame members 24*a*, a plurality of warp tension regulating dancing levers 40 pivoted to another annular member 24*f* having a circular section similarly fixed to the frames 24*a*, and a control means 41 which is capable of actuating when the dancing level 40 turns over a predetermined turning angle. These dancing levers 40 and the control means 41 constitute parts of the apparatus according to the present invention. The supporting arms 24*c* are rigidly held by the arm 24*b* as shown in FIGS. 2 and 3. As shown in FIGS. 1, 3, warps 3 are guided from the creels 6 through guide rolls 7*a* rotatably supported on a frame 9*c* and the yarn guides 39 to yarn guide apertures 40*b* formed on the top end portion 40*a* of each dancing lever 40, and a shed is formed by the shed forming mechanism, the structure of which is illustrated in detail in FIG. 4. The shuttle 26 propelled by the shuttle propelling mechanism 22 is inserted in this shed to weave the tubular fabric 2, and the tubular fabric 2 is taken out upwardly (in a direction indicated by an arrow in FIG. 3) through an annular gap formed between the circular edge of the horizontal guide member 27 and the annular guide 29, while being guided by a fabric guide member 31, and a guide frame 32 mounted on the guide member 31. Then, the tubular fabric is wound on a roll through the take-out means 8 by winding means (not shown).

Figure 4:
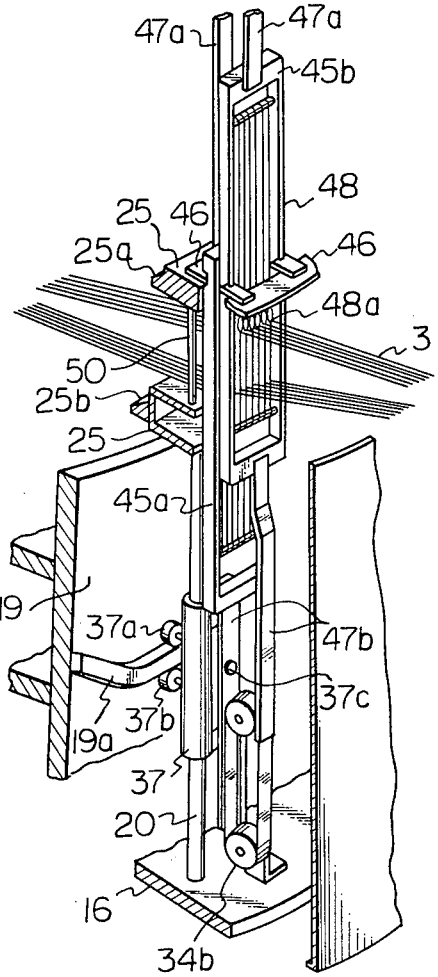
FIG. 4 is a perspective view of one unit of the shed forming mechanism of the circular loom, which is illustrated in FIGS. 1 and 3.

In the circular loom 1 having the above-mentioned structure, as shown in FIG. 4, the shed forming mechanism comprises a plurality of vertical guide rods 20 fixed to the peripheral flange portion of the disc-like frame 16, a cam-follower holding member 37 slidably mounted on the respective guide rods 20, a cam 19*a* projected from the periphery of the horizontal disc cam mechanism 19, a pair of cam-followers 37*a* and 37*b* which are rotatably mounted on the holding member 37 so that they have rolling contact with the cam 19*a* from above and below the cam 19*a*, respectively, heald frame guides 46 mounted on the upper guide ring 25*a* to guide a pair of heald frames 45*a* and 45*b* (heald frame guides are similarly mounted on the lower guide ring 25*b*, but they are omitted in FIG. 4), belts 47*a* and 47*b* for connecting both the heald frames 45*a* and 45*b* to move the heald frames 45*a* and 45*b* vertically in the opposite directions and thus form a fully open shed, a belt guide 34*a* mounted on the holding member 37 supported by the arm 24*b* to guide the belts 47*a* and 47*b*, and a belt guide 34*b* mounted on the peripheral flange portion of the disc-like frame 16. Since the holding member 37 to which the cam-followers 37*a* and 37*b* are attached is connected to the belt 47*b* by a pin member 37*c*, a vertical movement is given to the heald frame 45*a* by the vertical movement of the holding member 37. This vertical movement is transmitted to the other heald frame 45*b* through the belts 47*a* and 47*b*. Accordingly, a vertical movement reversed to the vertical movement of the heald frame 45*a* is given to the heald frame 45*b*. The same number of heald wires 48 are held by each of the heald frames 45*a* and 45*b*, and vertical rods 50 in a number corresponding to the number of the heald wires 48 are fixedly arranged lengthwise in a space between the confronting horizontal planes of the upper and lower guide rings 25. Since the shape of the cam face of the projecting cam 19*a* is designed with respect to the heald frames 45*a* and 45*b* so that a fully open shed is formed, when the warps 3 are passed through eyes 48*a* of the corresponding heald wires 48, respectively, a shed for forming a plain weave structure can be created by rotation of the horizontal disc cam mechanism 19. Since plural pairs of the above-mentioned paired heald frames 45*a* and 45*b* are annularly arranged along the periphery of the horizontal disc cam mechanism 19 adjacently to one another, these paired heald frames 45*a* and 45*b* form in succession sheds of identical shape with rotation of the horizontal disc cam mechanism 19. Accordingly, if a plurality of shuttles 26, for example, four shuttles as shown in the present embodiment, are propelled by the shuttle propelling mechanisms 22 synchronously with formation of these sheds, a tubular fabric 2 of a plain weave structure can be produced.

The structure and functional effect of the warp tension regulating and warp feed apparatus of the present invention will now be described in detail by reference of the above-mentioned embodiment of the circular loom to which the apparatus of the present invention is applied.

The warp tension regulating and warp feed apparatus of the present invention, which is adapted for the circular loom illustrated in FIG. 1, comprises means for absorbing the possible variation of warp-tension, which is disposed in the vicinity of the corresponding healds, and warp feed means disposed between the above-mentioned absorbing means and the creels, and these two means are functionally combined with each other in the apparatus of the present invention.

Figure 5:
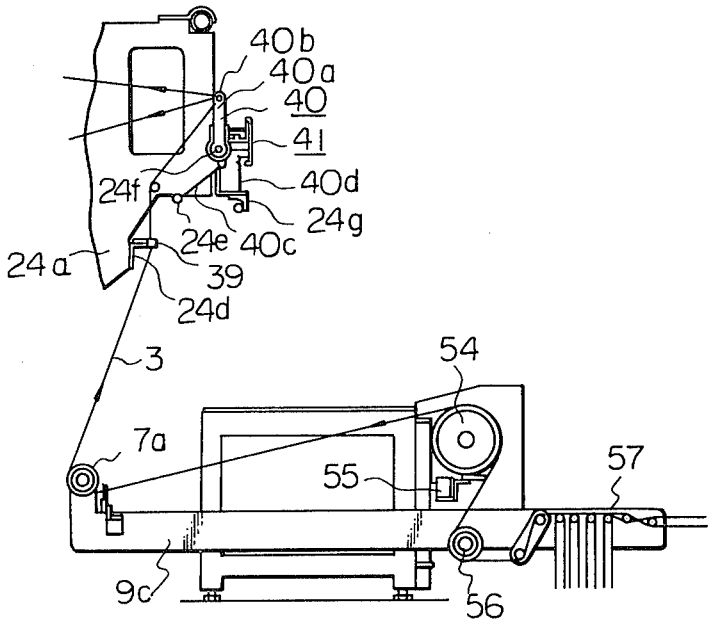
FIG. 5 is a detailed side view of the warp tension regulating and warp feed apparatus of the present invention attached to the circular loom illustrated in FIG. 1.
Figure 6:
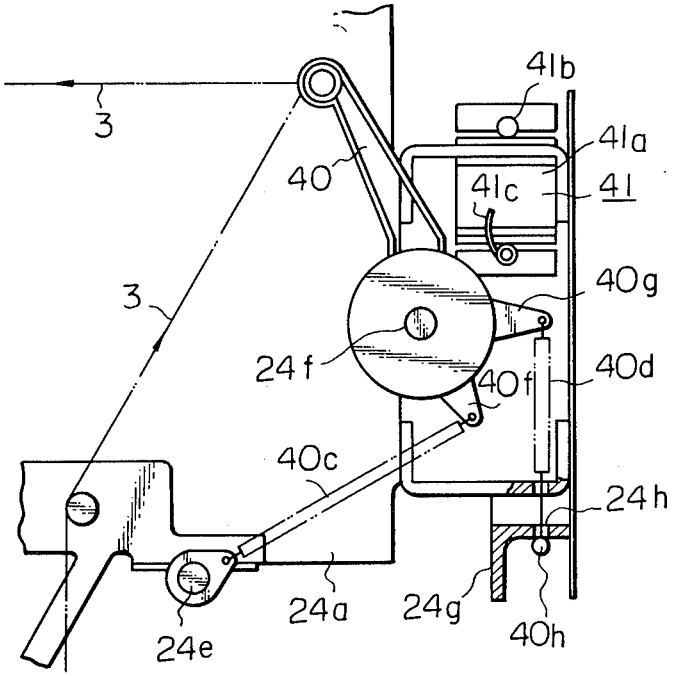
FIG. 6 is a schematic enlarged view of a part of the apparatus illustrated in FIG. 5.

As shown in FIGS. 3, 5 and 6, the absorbing means is provided with 2 kinds of springs 40*c* and 40*d* producing a rotation moment or torque coping with the tension of the warp 3 passing through the yarn guide 40*b* of the dancing lever 40. One spring 40*c* is arranged so that it is allowed to act over the entire allowable range of swinging of the dancing lever 40, while the other spring 40*d* is arranged so that it is allowed to act only when the turning angle of the dancing lever 40 exceeds the above-mentioned allowable range. More specifically, each dancing lever 40 is pivotably mounted on an annular member 24*f* held on the frame member 24*a*, and one end of each spring 40*c* is connected to a first projection 40*f* formed integrally with the corresponding dancing lever 40 and the other end is connected to an annular member 24*e* held on the frame member 24*a*. This spring 40*c* acts over the entire allowable range of swinging of the dancing lever 40. One end of the other spring 40*d* is connected to a second projection 40*g* formed integrally with the dancing lever 40, and the other end is freely, and movably inserted through an aperture 24*h* formed in an annular member 24*g* held on the frame member 24*a* and connected to a spherical fitting 40*b* outside the aperture 24*h*. The size of this spherical fitting 40*h* is larger than that of the aperture 24*h*, and an arrangement is made so that when the tension on the warp is increased and the dancing lever 40 is turned counterclockwise around the annular member 24*f* and falls in contact with the annular member 24*g* (this state is illustrated in FIG. 6), the spring 40*d* exerts its function for the first time. Accordingly, while the warp tension is low and is balanced with the reaction of the spring 40*c* and the dancing lever 40 is located outside the angular position shown in FIG. 6 with respect to the clockwise direction in the drawing, the spherical fitting 40*h* does not fall in contact with the annular member 24*g* and, hence, the spring 40*d* does not exert its function. In order to attain this adjustment function effectively, the operation force, that is, the spring constant, of the spring 40*c* is sufficiently smaller than that of the spring 40*d*.

The warp feed means functionally combined with the above-mentioned absorbing means is disposed between the creels 6 arranged on both the sides of the circular loom 1 symmetrically with each other and the circular loom 1. Referring to FIG. 5 illustrating one warp feed means, the warp 3 taken out from the package 6*a* (see FIG. 1) held on the creel 6 (see FIG. 1) is guided to the warp feed means. The warp feed means comprises dropper type tension imparting means 57 having a plurality of horizontal guide rods arranged in parallel to one another and droppers suspended from the horizontal guide rods for respective warps, a warp feed roller 54 rotated at a peripheral speed higher than the warp consumption speed of the circular loom 1 by means of an electric motor 55 and a guide roller 56 disposed between the roller 54 and the dropper type tension imparting means 57. The peripheral surface of the warp feed roller 54 is covered with a material having an appropriate friction coefficient, and each warp 3 is fed to the guide roller 7*a* by the frictional contact force of the warp 3 with the surface of the roller 54. Accordingly, the higher the tension on the warp 3, the larger this frictional contact force, and therefore, the warp is fed out at a feed speed approximating the peripheral speed of the roller 54. On the other hand, as the tension on the warp 3 is low, slip between the warp 3 and the roller 54 is created and the amount fed of the warp 3 to the guide roller 7*a* is decreased. As the amount fed of the warp 3 is decreased, the warp tension is gradually increased and, hence, the frictional contact force of the warp 3 with the peripheral surface of the roller 54 is increased and the above-mentioned slip is gradually reduced. As a result, the amount fed of the warp 3 is gradually increased and the warp tension is decreased. Thus, the tension of the warp 3 fed to the circular loom 1 is automatically controlled. Since the tension on the warp 3 is influenced by the contact friction between the warp 3 and the roller 54 and the peripheral speed of the roller 54, as will be understood from the foregoing illustration, in practical operation, the rotation number of the electric motor 55 is adjusted according to the desired warp tension and it is possible to always maintain the tension of the warp 3 supplied to the circular loom 1 within an allowable range.

In the above-mentioned circular loom, the shed forming and filling motions are performed so that shuttles 26 are travelled in one direction along the annular guide member 25 and shed forming mechanisms arranged annularly form fully open sheds in succession prior to arraival of each shuttle 26, and after the shuttle 26 has passed through the respective sheds, these sheds are closed in succession. Accordingly, warps 3 fed to the circular loom 1 are moved while forming groups corresponding to respective shed forming mechanisms, and variations of tensions thereof are caused independently in the respective groups of the warps 3. In order to enhance the weaving efficiency, relatively large shuttles are used for the circular loom, that is, relatively large filling-yarn packages are used. Accordingly, each shuttle 26 tends to fall in contact with warps 3 when they are inserted into sheds, resulting in further increase of tensions on the warps 3. These variations of tensions on the warps, however, can be absorbed by the turning movements of the dancing levers 40, and therefore, the above-mentioned direct influences on the warp feed means are substantially eliminated. In other words, variation of warp tensions caused by the shed forming and filling motion have no direct influences on control of the amounts of warps fed by the warp feed means. Accordingly, the amounts of warps fed by the warp feed means can be adjusted according to the warp consumption speed in the circular loom while maintaining the warp tensions within a predetermined desirable range.

Figure 7:
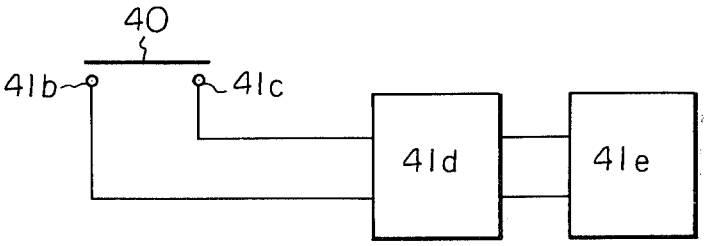
FIG. 7 is a block diagram illustrating an electric connection in the apparatus illustrated in FIG. 5.

In the warp tension regulating and warp feed apparatus of the present invention, there is disposed automatic detecting stopper means to prevent occurrence of operational troubles when the feed rate of warps is excessively higher than the warp consumption speed in the circular loom or warps are cut. In an embodiment illustrated in FIGS. 6 and 7, a detecting member 41*a* of the control means 41 is disposed in a position adjacent to each dancing lever 40, and when the tension on the warp 3 is extremely weakned or the warp 3 is cut, the dancing lever 40 is turned in the clockwise direction in the drawing to actuate the detecting member 41*a* to operate alarming means or stopper means 41*e* through a relay 41*d* according to a signal issued from the detecting member 41*a*. In this embodiment, the detecting member 41*d* comprises a conductor 41*b* attached to an insulator and a tongued conductor 41*c*, and the back face of the dancing lever 40 (on the side of the conductors 41*b* and 41*c*) is covered with a conductor and the conductors 41*b* and 41*c* are connected to the relay means 41*d*. Accordingly, when the dancing lever 40 is turned in the clockwise direction and falls in contact with the conductors 41*b* and 41*c*, the relay means 41*d* is actuated to operate the alaming means or stopper means 41*e*. The stopper means 41*e* has such a function that when contacts (conductors) 41*b* and 41*c* are electrically connected by contact with the dancing lever 40, the relay 41*d* is actuated to break off an electric connection between the power source and electric motor 5. The alarming means gives an alarm when it is actuated by the relay 41*d*. The structures of these stopper means and alarming means are well-known. Accordingly, explanation of these means is omitted.

The structure and functional effect of the warp tension regulating and warp feed apparatus of the present invention has been described in detail by reference to the embodiment where the apparatus of the present invention is applied to the circular loom illustrated in FIG. 1. The apparatus of the present invention can be applied to the circular looms having a similar function, and the experiences of the inventors of the present invention, it is apparent that, even if the apparatus of the present invention is applied to other similar to the above embodiment is similarly attained. Moreover, the principle of the present invention can be effectively applied to looms where a warp feed system of taking out warps from respective yarn packages independently is adopted, such as tire cord weaving looms circular looms, the functional effect described by reference.

I claim:

1. A warp tension regulating and warp feed apparatus for a circular loom comprising an annular guide member for guiding at least one shuttle, a shuttle propelling mechanism for propelling the shuttle in a certain direction along said guide member, a warp guide annular member disposed above said annular guide member and coaxially therewith, said warp guide annular member having a plurality of warp guide slits, a plurality of shed forming mechanisms arranged annularly outside said warp guide annular member, operating means for operating said shed forming mechanisms prior to arrival of said shuttle to form successive sheds, a take-up mechanism for taking up a formed weave fabric along the axis of the annular shuttle guide member and at least one source for feeding warps to the shed forming mechanisms comprising; means for absorbing variations of tensions created on said warps caused mainly by the shedding motion, a continuously rotating warp feed roller disposed at a position between said warp tension variation absorbing means and said warp supply source, drive means including an electric motor for continuously rotating said warp feed roller at a peripheral speed higher than the warp consumption speed of said circular loom, whereby the rate of feed of said warp is controlled by the tension in said warp, provided by said tension absorbing means for controlling the tension upstream of said tension absorbing means, and means for guiding said warps taken out from said warp supply source to said warp feed roller, said warp feed roller being provided with a cylindrical friction-surface formed on a cylindrical peripheral surface thereof for guiding said warps.

2. A warp tension regulating and warp feed apparatus according to claim 1 wherein said circular loom further is provided with an annular supporting member disposed outsides said warp guide annular member and adjacently to said warp guide annular member coaxially therewith and an auxiliary supporting member disposed ouside a machine frame, said warp tension variation absorbing means comprising a plurality of dancing levers corresponding to the respective warps and resilient means connected to each of said dancing levers, each of said dancing levers is pivoted on said annular supporting member and provided with a yarn guide for guiding the warp on one end portion thereof and two projections formed on the sides opposite to each other with respect to the pivoting axis of said dancing lever, said resilient means comprising two springs different in the spring constant connected to the ends of said two projections, respectively, and the other end of the first spring having a smaller spring constant is fixed to the auxiliary supporting member and the other end of the second spring having a larger spring constant is connected with a certain clearance to said auxiliary supporting member, so that said first spring is allowed to act over the entire allowable range of swinging of the dancing lever and said second spring is allowed to act only when the swinging movement of the dancing lever exceeds a predetermined allowable angular position and said clearance is eliminated.

3. A warp tension regulating and warp feed apparatus according to claim 1, wherein detecting means for detecting an abnormal warp tension is disposed for each warp co-operatively with said warp tension variation absorbing means.

4. A warp tension regulating and warp feed device according to claim 2, wherein said warp tension variation absorbing means is cooperated with said auxilairy supporting member, said auxiliary supporting member is provided with a plurality of apertures formed at positions corresponding to said dancing levers, an end portion of said second spring is inserted into the corresponding one of said appertures in such a condition that it is capable of freely passing therethrough, a spherical member which cannot pierce said aperture is fixed to said end portion of said second spring at a position below said aperture, and a clearance is formed between said spherical member and said appendix supporting member, so that when the warp tension is within an allowable range, the spherical member separates from said supporting member and only when the warp tension becomes abnormally large and exceeds the allowable range, is the spherical member pressed to the edge of said aperture of said supporting member.

5. A warp tension regulating and warp feed apparatus according to claim 1, wherein said means for guiding the warps to the warp feed roller comprises a dropper type tension imparting device disposed between the warp feed roller and said warp supply source, one guide roll disposed between said dropper type tension imparting device and said warp feed roller and another guide roll disposed between said warp tension variation absorbing means and said warp feed roller.

* * * * *